US010919741B2

(12) United States Patent
Hall et al.

(10) Patent No.: US 10,919,741 B2
(45) Date of Patent: Feb. 16, 2021

(54) MOVING DRUM WINCH

(71) Applicant: Hall Labs, LLC, Provo, UT (US)

(72) Inventors: David R. Hall, Provo, UT (US); Jerome Miles, Spanish Fork, UT (US); Daniel Madsen, Vineyard, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/408,458

(22) Filed: May 9, 2019

(65) Prior Publication Data

US 2020/0354201 A1 Nov. 12, 2020

(51) Int. Cl.

| | |
|---|---|
| ***B66D 1/36*** | (2006.01) |
| ***B66D 1/39*** | (2006.01) |
| ***B66D 1/38*** | (2006.01) |

(52) U.S. Cl.

CPC ..... *B66D 1/365* (2013.01); *B66D 1/38* (2013.01); *B66D 1/39* (2013.01)

(58) Field of Classification Search

CPC . B66D 1/36; B66D 1/365; B66D 1/38; B66D 1/39

See application file for complete search history.

(56) References Cited

U.S. PATENT DOCUMENTS

| | | | | |
|---|---|---|---|---|
| 1,973,446 | A * | 9/1934 | Resenquist | B66D 1/38 242/483 |
| 3,690,409 | A * | 9/1972 | Brauss | B66D 1/14 182/142 |
| 5,636,648 | A * | 6/1997 | O'Brien | B08B 9/04 134/107 |
| 6,511,089 | B1 * | 1/2003 | Kores, Sr. | B60D 1/38 280/478.1 |
| 6,523,806 | B2 * | 2/2003 | Bartal | B66D 1/00 254/272 |
| 9,719,632 | B2 * | 8/2017 | Weidner | F16M 13/022 |
| 9,908,754 | B2 * | 3/2018 | Hall | B66D 1/22 |
| 10,640,344 | B1 * | 5/2020 | Hall | B66D 1/00 |
| 2017/0166422 | A1 * | 6/2017 | Mahnken | B66D 1/39 |
| 2017/0320711 | A1 * | 11/2017 | Hampton | B66D 1/38 |
| 2018/0093869 | A1 * | 4/2018 | Hall | B66D 1/365 |

* cited by examiner

*Primary Examiner* — Sang K Kim
*Assistant Examiner* — Nathaniel L Adams

(57) ABSTRACT

A winch assembly including a mount attachable to a vehicle, and a guide attached to the mount; including a winch having a drum for winding and unwinding a line, and a motor for driving the drum about a winding axis, wherein the drum has a helical groove for receiving the line as it is wound. A frame connects to the first and second end of the drum and is adapted to move relative to the guide so as to synchronize movement of the drum along the winding axis so that the line is aligned with the helical groove during winding and unwinding. A rod is attached to the frame and generally parallel to the winding axis, and passes through a hole in the guide, allowing the movement of the drum along the winding axis but preventing the frame from rotating about the winding axis is disclosed.

18 Claims, 8 Drawing Sheets

MOVING DRUM WINCH

TECHNICAL FIELD

The present disclosure relates generally to the field of winches.

BACKGROUND

Winches are pulling or lifting devices, which pull in or let out a line. Winches function by winding or unwinding the line that is coiled around a rotating drum. A winch fairlead is commonly used to direct the line as it winds or unwinds along the drum. Typically, the line should be at a shallow angle, 20 degrees or less, from perpendicular to the drum axis. When this is achieved, friction is minimized between the line and the internal edges of the fairlead that surround the line. Most efficiently, the line is exactly perpendicular to the drum axis. Thus, a problem arises if the line is connected to a load that is at a wide angle, such as when the load is at an angle of 45 degrees, causing the line to be at a 45 degree angle from perpendicular to the drum axis. Friction created between the line and the fairlead reduces the pulling capacity of the winch and shortens the life of the line (can cause the line to fray, for example).

SUMMARY

In a first aspect, the disclosure provides a winch assembly including a mount attachable to a vehicle, and a guide attached to the mount; including a winch having a drum for winding and unwinding a line, and a motor for driving the drum about a winding axis, wherein the drum has a helical groove for receiving the line as it is wound. A frame connects to the first and second end of the drum, and is adapted to move relative to the guide so as to synchronize movement of the drum along the winding axis so that the line is aligned with the helical groove during winding and unwinding. A rod is attached to the frame and generally parallel to the winding axis, and passes through a hole in the guide, allowing the movement of the drum along the winding axis but preventing the frame from rotating about the winding axis is disclosed.

In a second aspect, the disclosure provides a winch assembly wherein walls of the helical groove extend radially a distance greater than a diameter of the line, and wherein an internal surface of the guide comprises a helical ridge that engages with the helical groove. A third aspect provides a winch wherein the line lays in the helical groove and radially extends beyond walls of the helical groove, and wherein an internal surface of the guide comprises a helical ridge that engages with the line in the helical groove. Furthermore, the guide and winch may pivot freely. The guide may contain bearings to accomplish pivoting and may also include a locking pin to hold the winch in a home position.

Additionally, in a preferred embodiment, the mount includes an extendable and retractable arm, whereby the guide and winch can be extended a greater distance from the vehicle to facilitate pivoting. The extendable and retractable arm may be motorized or manually operated. Furthermore, the invention may include a torsion spring attached to the guide and the mount for holding the winch in a home position when a load is not pulling the winch. In another embodiment, the winch assembly includes batteries.

In another embodiment, the winch assembly includes a mount attachable to a vehicle, a guide attached to the mount with a fairlead, a winch with a drum for winding and unwinding a line, and a motor for driving the drum about a winding axis. The drum has a helical groove for receiving the line as it is wound, and the line passes through the fairlead. The winch assembly also includes a frame connected to the first and second end of the drum, and a threaded rod rotatably attached to the frame and generally parallel to the winding axis, and passing through a threaded hole in the guide, such that as the threaded rod is rotated about an axis parallel to the winding axis, the frame is moved along the winding axis and the frame is prevented from rotating about the winding axis. The movement of the frame by rotation of the threaded rod is configured to synchronize movement of the drum along the winding axis so that the line passing through the fairlead is aligned with the helical groove during winding and unwinding.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
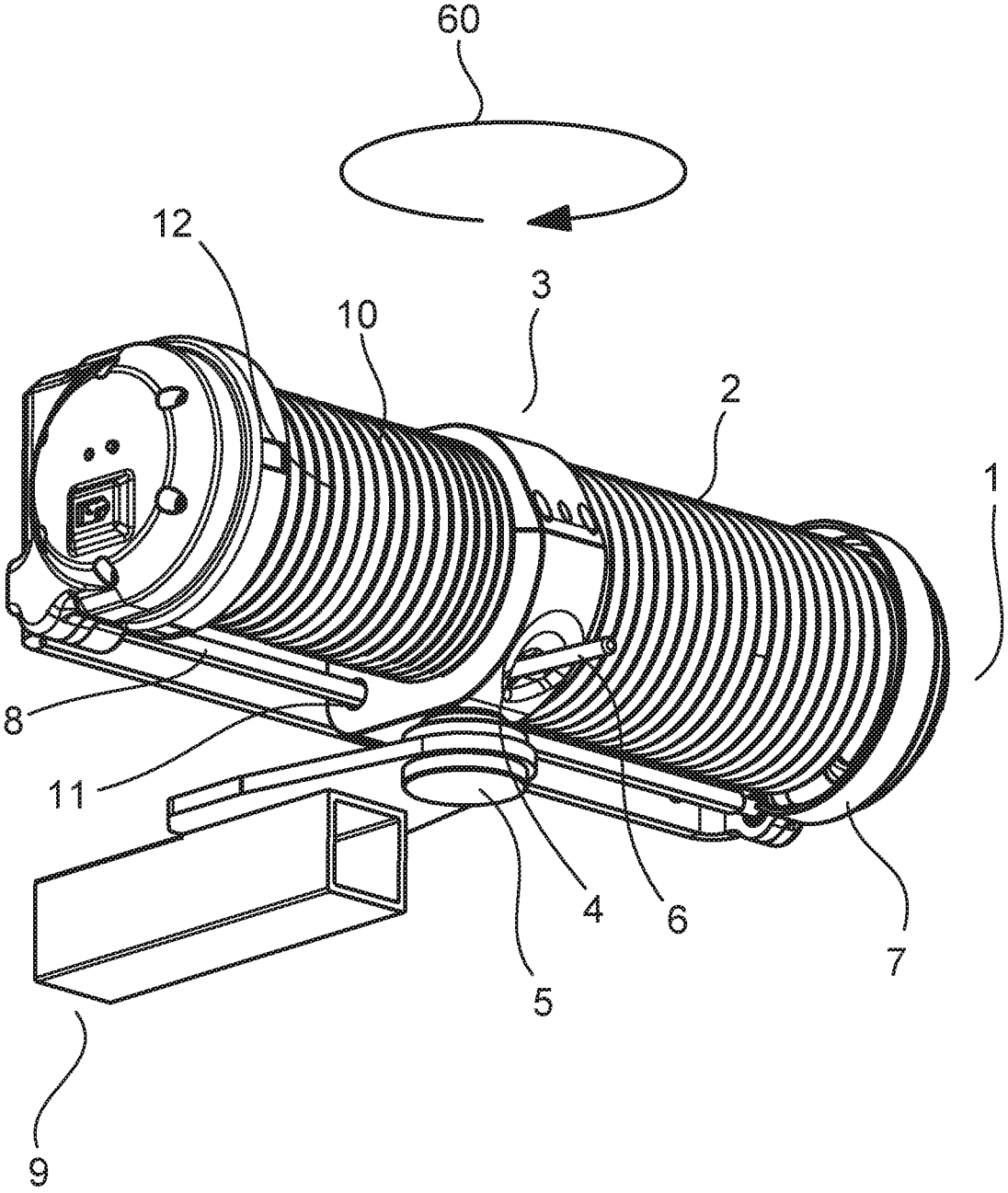
FIG. 1 is a perspective view of the winch assembly.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure, and are not meant to be limiting in any fashion. Nor do these phrases indicate any kind of preference for the disclosed embodiment.

As used herein, "threaded" is meant to refer to a helical ridge on the outside of an object, or on the inside of a cylindrical hole.

As used herein, "home position" is meant to refer to the drum axis being perpendicular to the winch mount.

Winches in their most basic form have been used for many years to help hoist or move objects. Winches can be used in a variety of settings. They are used on boats, on cars, in a building, on a construction site, indoors or outdoors. They are extremely useful because they help users to maneuver often large or heavy equipment or materials in such a way that would be extremely difficult to do manually.

Winches are used to pull in or let out tension on a line, such as a cable or rope. There exists a wide variety of winches comprised of different materials. One of the challenges associated with winches is that pulling capacity may be diminished when a load is not perpendicular to the drum. Typically, this challenge is addressed by using a fairlead that includes rollers to reduce the friction associated with off-angle loads (loads that result in the winch line being more than 20 degrees from perpendicular with the winch drum axis, for example). However, even with a fairlead that includes rollers, the winch capacity for off-angle loads is reduced, and the pressure and friction of the fairlead may result in increased wear on the winch line and/or the winch components. Depending on the environment and scenario in which a winch is used, one of the common use cases for winches, for example, is for a winch to be placed on a vehicle (e.g., all-terrain vehicle (ATV), truck, utility vehicle, and the like). Typically, the winch is placed at the front (or back) of the vehicle. This placement may be ideal for some use cases. A vehicle, however, may or may not be able to be situated directly in the front or the back of the load to be pulled. Furthermore, the vehicle may or may not be able to be situated on the same level as the load to be pulled. When using the winch, it is most efficient when directly facing the load it is pulling because friction is reduced and efficiency is increased. Thus, it is beneficial for a winch to have the ability to tilt, rotate, and/or twist in order to face the load being pulled so that it is directly facing the load to be pulled.

It is appreciated that pulling off-angle can reduce the efficiency and ability of winches. Pulling off-angle, however, may be particularly problematic for winches that include a winch-line-guide that directs the line to wind along the length of the rotatable drum to avoid bunching or catching the line on the rotatable drum. In one embodiment, a motor powers the drum to rotate about an axis within a frame. A fairlead of the winch-line-guide may be connected to and may simultaneously move along the length of one or more elongated rods, which extend longitudinally within the frame in substantially parallel relation to the drum axis. As the fairlead moves along the rod, the line passes through the fairlead such that the fairlead directs the line to wind uniformly around the drum. When pulling off-angle, however, the fairlead may, at times, be unable to move along the drum length due to the force of the load working against the movement direction of the fairlead.

Another challenge associated with winches is that pulling capacity may be diminished when a load is not being pulled from the center of the winch drum. Even when a winch swivels to face the load it is pulling, the efficiency of the winch is reduced wherein the winch is not pulling from the center of the winch drum. Because guides typically travel the length of the drum to wind or unwind the line on and off the drum, the winch is only at its most efficient pulling capacity briefly, when the guide is at the center of the drum. The winch pulls least efficiently when the guide is at a drum end.

This problem is addressed by keeping the line at the center of the winch, preferably the point at which the winch is anchored to another object. For example, right above the mount. When the guide is attached to the mount, the line remains at the center, and is able to pull most efficiently. In a preferred embodiment, the guide is attached to the mount, and line is unwound or wound onto the drum via the fairlead. As the guide is attached to the mount, the drum moves through the guide from one end to another, facilitating the winding or unwinding of the line.

In order for the drum to move through the guide, in a preferred embodiment, the line lays in the helical groove of the drum, and extends radially beyond the helical drum. Furthermore, the guide is threaded, or has a mating pitch, such that it meshes with the line, allowing the drum to move from one end point to another through the guide as the motor spins the drum. In another embodiment, however, the walls of the helical groove of the drum extend radially beyond the line, such that the walls of the helical groove mesh with the threaded guide, acting like a track, such that the drum moves through the guide.

Furthermore, when a winch is able to swivel or pivot towards the object it is pulling and thus reduce friction of the line against the fairlead, the winch may run into or hit the vehicle to which it is attached or mounted if it is not far enough away from the vehicle. In other words, if the winch pivots from the center of the drum, and the distance the winch is placed from the vehicle is not the same as or greater than the distance from the middle of the drum to the end of the drum, the winch will not be able to pivot 90 degrees. For example, very often an individual will attach a winch to a vehicle such as an ATV or truck. Often, a user attaches a winch to the front of their vehicle. This is useful for transporting a winch and using the winch. However, wherein a winch is closely mounted to the front of a vehicle, it would be unable to swivel very far because it will hit or come into contact with the vehicle or become obstructed by the vehicle. Therefore, wherein a winch is made to swivel or pivot, it is useful for a winch to be able to extend away from the vehicle. Then, when a user needs to use the winch at an angle, they can move the winch such that it is sufficiently far enough from the vehicle that it can swivel and not be obstructed by the vehicle. Once the user is finished using the winch at an angle, they can retract the winch to a position that is closer to the vehicle. Storing a winch closer to the vehicle is advantageous because it less likely that the winch will get hit or come into contact with another object thereby damaging the winch or the object that it comes into contact with.

Embodiments and methods disclosed herein may improve winch performance when the load is at a wide angle to the fairlead. The present devices, systems, and methods describe a winch that includes a swivel mechanism. As described herein, the winch assembly may swivel to orient itself in a way that minimizes or eliminates off-angle loads. In other words, the winch assembly may rotate towards a load that the winch is pulling, such that there is less friction on the line when being wound onto the drum. This allows for increased efficiency and increases the capacity of the winch to pull heavier items or loads. The winch may be made to swivel towards the object that it is pulling in a variety of ways. In one example, the winch swivels freely. In another, it comprises sensors.

The winch may extend and retract in a variety of ways. For example, in one embodiment the winch comprises a pin, a winch mount base, and an extendable arm that nests inside the winch mount base. In another embodiment, the winch mount base nests inside the extendable arm. The user may remove the pin, extend the extendable arm, and reinsert the pin, thus allowing a user to manually extend the extendable arm. In another embodiment, the winch comprises a crank handle in place of a pin that when cranked, extends the extendable arm. In another example, the winch is automated and can be controlled via a remote device. In one example, the remote device is a smart phone running an app. In yet another embodiment, the winch is controlled mechanically and manually, such that a user can decide to manually extend or retract the winch or use a controller to extend or retract the winch. In another embodiment, the extendable winch assembly includes a button on the winch that when pressed mechanically extends or retracts the extendable arm.

In one embodiment, wherein the extendable arm nests inside the winch mount base, the extendable arm rests on a track. In a preferred embodiment, the track includes a motor such that the extendable arm is mechanically extended or retracted. However, in a less preferred embodiment, there is no motor and the user manually moves the extendable arm along the track to extend or retract the winch. In another embodiment, wherein the winch mount base nests inside the extendable arm, the winch mount base comprises a track such that the extendable arm can extend and retract.

In a preferred embodiment, the extendable winch assembly includes an extendable arm that nests inside the base of the winch mount. The base may attach to the underside of the vehicle, or to the front, back or side. It may attach with screws or glue.

Wherein the winch swivels freely, the winch mount may comprise ball bearings where the winch mount is attached to the extendable arm, such that it can spin, swivel, or pivot freely when a load pulls on the winch line at an off angle. In another example, the winch mount comprises roller bearings.

In one embodiment the winch assembly may include sensors in proximity to the orifice on the fairlead which sense/detect pressure. When pressure exceeds a predetermined threshold, the winch assembly is instructed to swivel, tilt, and/or rotate in the direction that will most relieve the sensed pressure. Thus, sensors may be used to allow the fairlead to operate without decreasing efficiency.

In some embodiments, the winch mount (to which the winch is mounted, for example) may oscillate, rotate, balance, pivot, turn, tilt, teeter, vacillate, hover, hang, sway, and/or dither. The winch may include one or more spacers, insertions, and/or attachments between the rotatable drum and the winch mount. Some embodiments of the winch mount may include one or more protrusions, attachments, flanges, extensions, shelves, depressions, grooves and/or other surface discontinuities that interact with springs. In one embodiment, the winch mount may include one or more folds, bends, creases, and/or curvatures such that the degree to which the rotatable drum tilts is as much as 180° from rest. The winch mount may also rotate as much as 360° around the center pivot, according to one embodiment.

In one embodiment, the winch assembly is electric. In another embodiment, the winch assembly is hydraulic. The winch assembly may also include batteries. In one embodiment, the line is synthetic rope, and in another, the line is a steel cable.

In another embodiment, the winch comprises sensors in proximity to the orifice on the fairlead which sense/detect pressure. When pressure exceeds a predetermined threshold, the winch is instructed to swivel, tilt, and/or rotate in the direction that will most relieve the sensed pressure. Thus, sensors may be used to allow the fairlead to operate without decreasing efficiency.

The following detailed description refers to the accompanying drawings. The same reference numbers may be used in different drawings to identify the same elements. In the following description, for purposes of explanation and not limitation, specific details are set forth such as particular structures, architectures, interfaces, techniques, etc. in order to provide a thorough understanding of the various aspects of various embodiments. However, it will be apparent to those skilled in the art having the benefit of the present disclosure that the various aspects of the various embodiments may be practiced in other examples that depart from these specific details. In certain instances, descriptions of well-known devices, circuits, and methods are omitted so as not to obscure the description of the various embodiments with unnecessary detail.

Now referring to FIG. 1, a winch assembly 1 is shown. The drum 2 is attached to the frame 7. The guide 3 is at the center of the drum 2, and is attached to the swivel mount 5. The swivel mount 5 is attached to the vehicle mount 9. The line 6 extends through the fairlead 4 on the guide 3. The rod 8 extends the length of the drum 2 and attaches to the frame 7 at the first and second end of the drum 2. The rod 8 prevents the winch 1 from spinning about or around the drum axis as line 6 is wound or unwound off the drum 2. The rod 8 runs through a hole in the guide 11. Because the guide 3 is attached to the swivel mount 5, the guide 3 does not move (up and down). In a preferred embodiment, the line 6 lays in the helical groove 10 such that the line 6 is taller than, or extends beyond, the walls of the helical groove 10. The walls of the helical groove form the crevices along the drum 2 that the line 6 lies in such that the line does not lie on top of itself or get tangled. As such, the line 6 creates ridges, or peaks, as it wraps around the drum 2. Alternatively, the walls of the helical groove 12 are taller than, or extend beyond the line 6, such that the line 6 lays inside the helical groove 10. In this embodiment, the walls of the helical groove 12 mesh with the guide 3.

Figure 2C:
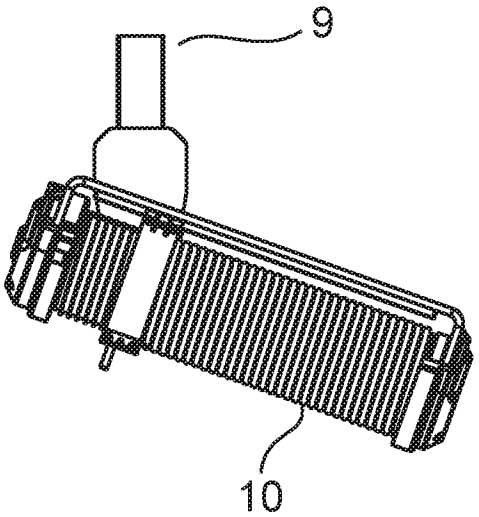
FIG. 2C is a top view of the winch assembly with a swivel mount wherein the winch has swiveled towards the load and the drum is moving laterally towards the second end.
Figure 2B:
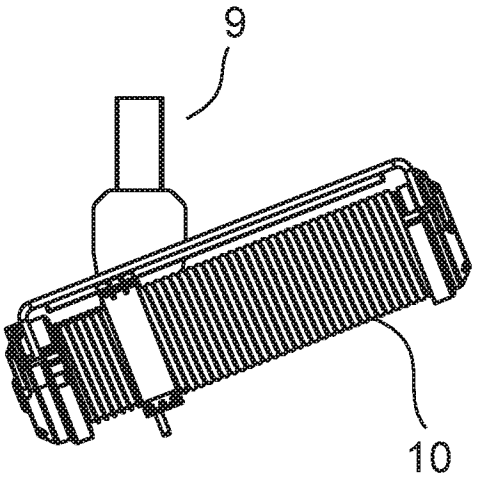
FIG. 2B is a top view of the winch assembly with a swivel mount wherein the winch has swiveled, and the drum has moved laterally towards the first end.
Figure 2A:
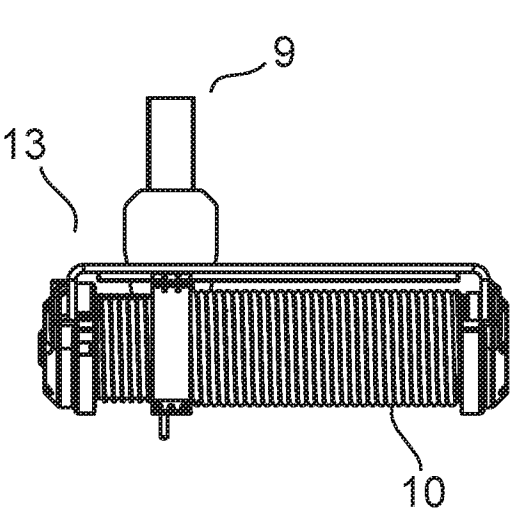
FIG. 2A is a top view of the winch assembly with a swivel mount wherein the winch drum has moved laterally towards a first end of the drum but the swivel mount has not swiveled.

FIG. 2A illustrates the winch assembly 1 wherein the drum has moved to the right. However, the load is still placed directly in front of the winch assembly 1, because the winch has not swiveled to the left or right. Although the drum 2 has moved laterally through the guide 3, the guide 3 has remained in the same spot attached to the mount.

FIG. 2B shows the winch assembly 1 wherein it has pivoted slightly. This will occur wherein the load that a user wishes to pull with his winch assembly 1 is not perfectly centered with his winch assembly 1, meaning that it is causing the line to pull at an angle, such as 45 degrees, from perpendicular to the drum axis. By allowing the winch assembly 1 to swivel freely, the load will automatically be pulled from the most efficient point. FIG. 2C shows the winch assembly 1 swiveling to the other side (relative to FIG. 2B), indicating that the load it is pulling is coming from a different direction. Regardless of the direction of the load in relation to the winch assembly 1, the guide remains stationary and attached to the mount, and the winch drum 2 moves back and forth through the guide to wind on or wind off the line 6.

Figure 3:
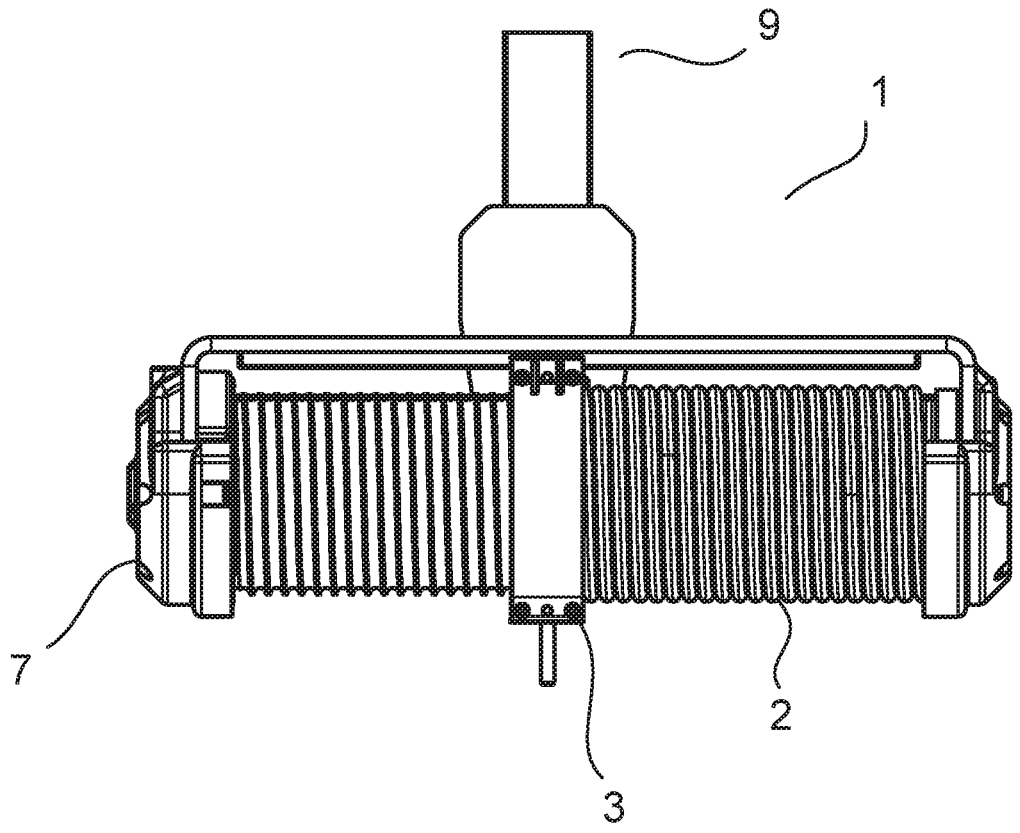
FIG. 3 is a top view of the winch assembly.

FIG. 3 is a top view of the winch assembly 1, wherein about half of the line 6 is unwound from the drum 2. The remaining line 6 will be unwound if the winch assembly 1 moves through the guide 3 to the left. The guide pivots as the winch pivots, but it does not move laterally.

Figure 4:
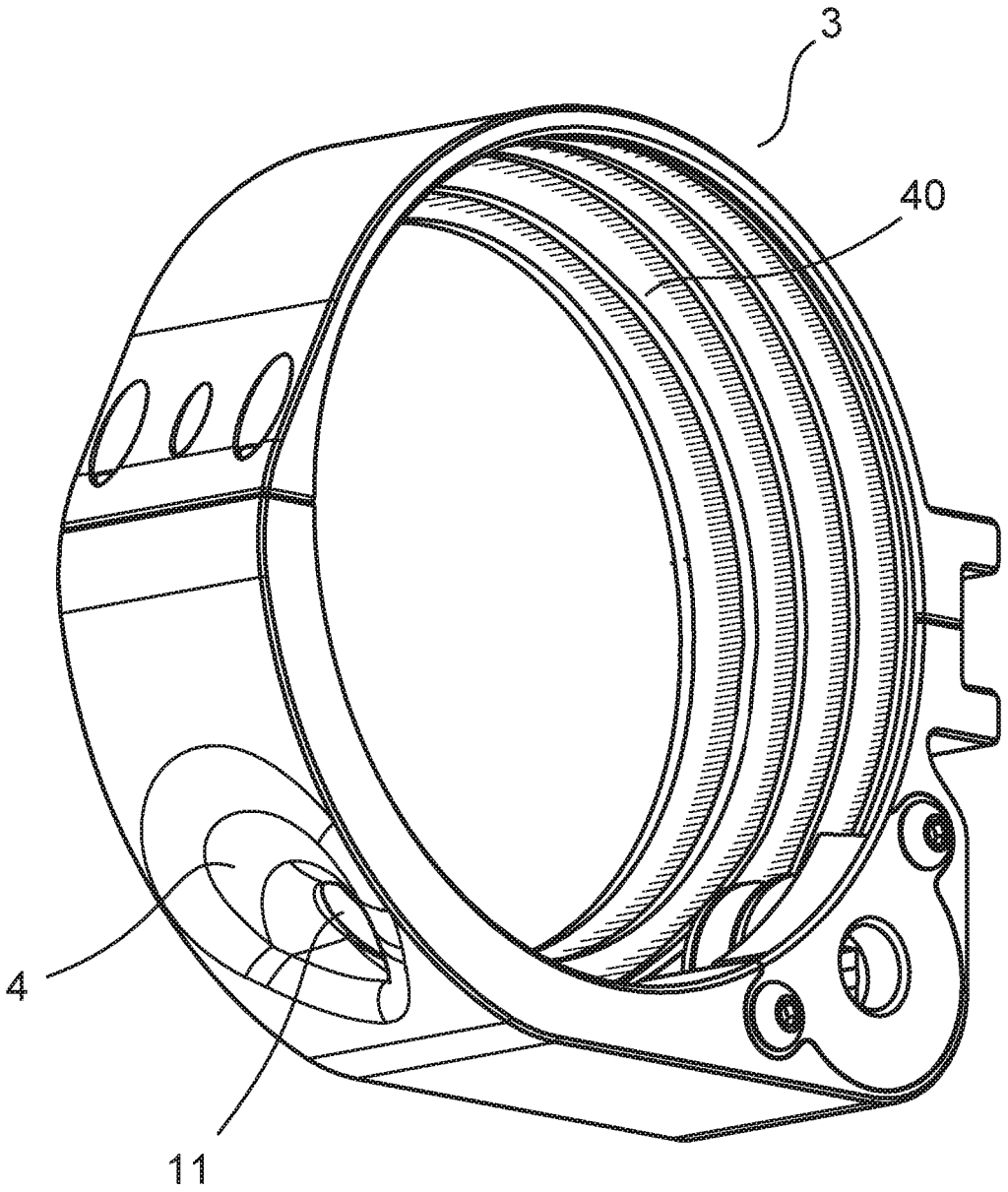
FIG. 4 is a perspective view of the guide.

FIG. 4 illustrates the guide 3 and the fairlead 4. In this embodiment of the guide 3, the inside of the guide has grooves and ridges 40 such that, when wound around the drum in the helical groove, the line 6 meshes with the grooves and ridges 40 and causes the drum to move from one side to the other as the motor spins the drum.

Figure 5:
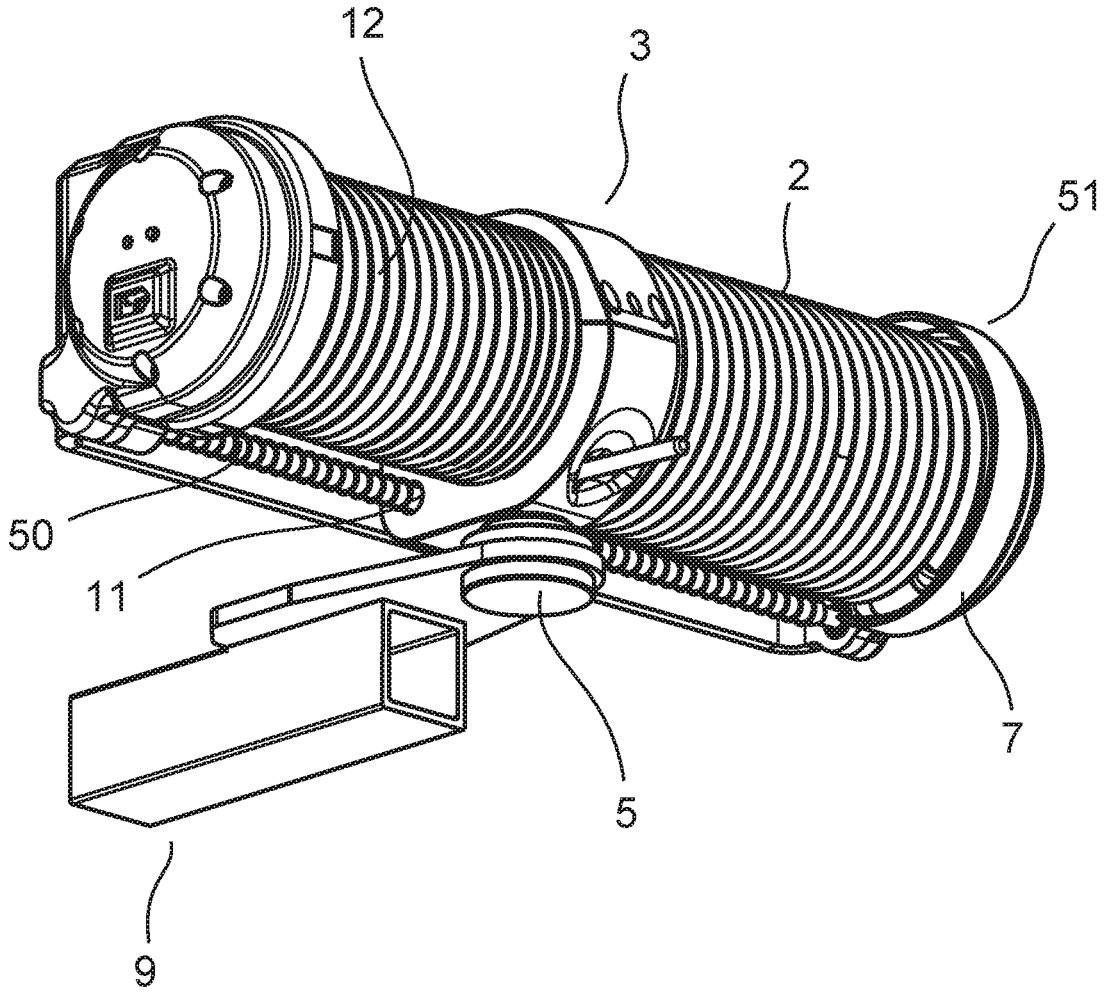
FIG. 5 is a perspective view of the winch assembly wherein the rod is threaded.

FIG. 5 depicts a winch assembly 51 wherein the rod 50 is threaded. In this embodiment, the portion of the guide through which the drum passes is not threaded, but the hole 11 in the guide 3, through which the rod 50 passes, is threaded with a mating pitch. As the motor spins the drum, the threaded rod 50 also spins. (However, in an alternative embodiment, the winch assembly 51 comprises two motors. One that spins the rod 50 and one that spins the drum 2). As the guide 3 remains at the mounting point, the drum 2 moves through the guide 3 from a first end cap to a second end cap, or from a second end cap to a first end cap. In a less preferred embodiment, both the rod 50 and the guide 3 are threaded. The guide 3 is threaded with a mating pitch such that the line or walls of the helical groove mesh with the guide.

In another embodiment, however, both the rod 50 and the guide 3 are threaded. This allows for two tracks, which allows the drum to be more robustly moved laterally. In this embodiment, the guide hole 11 through which the rod 8 passes is threaded, and the side of the guide 3 that comes into contact with the drum is also threaded. Furthermore, in this embodiment, preferably the line 6 extends radially beyond the walls of the helical groove 12. However, in another embodiment, the rod is threaded, the guide is threaded, and the walls of the helical groove extend radially beyond the line, such that they come into contact and mesh with the guide, instead of the line meshing with the guide.

In another embodiment, the winch assembly 1 includes two motors. One motor spins the drum, and another motor spins gearing that rotates the rod such that the winch travels laterally through the guide. Furthermore, the winch assembly may be remote controlled. In a preferred embodiment, the remote control is a cell phone running an app. Alternatively, the winch assembly may comprise buttons on the winch that allow a user to control the winch, such as turning it off and on.

Figure 6:
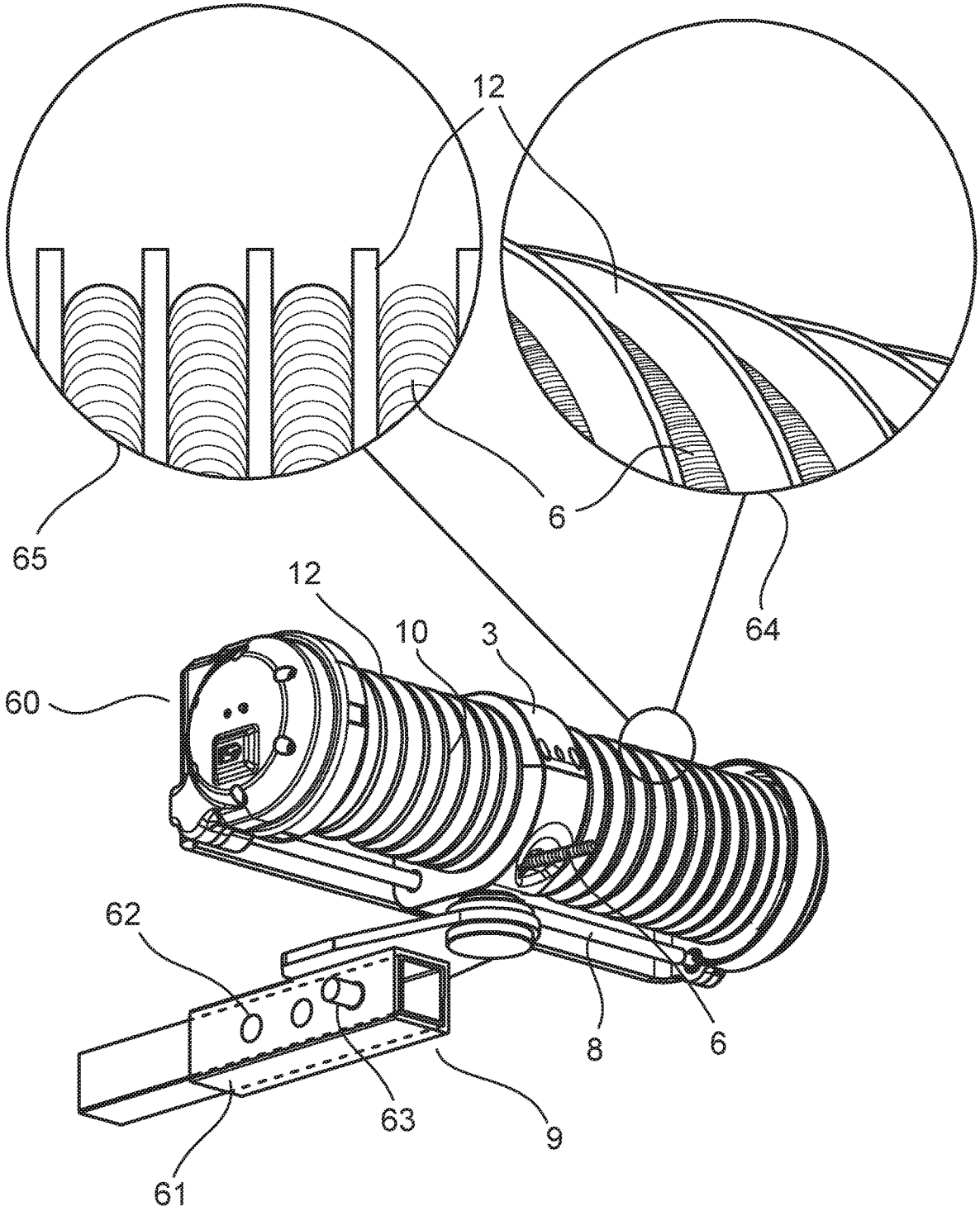
FIG. 6 is a perspective view of the winch assembly including an extendable and retractable arm.

FIG. 6 depicts the winch assembly 60 wherein the line 6 does not extend radially beyond the walls of the helical groove 12. As such, the walls of the helical groove 12 mesh with the guide 3 such that the drum 2 is able to move back and forth through the guide 3 as the motor spins the drum 2. Insert 64 shows a zoomed-in version of the drum, making it clearer that the line 6 doesn't extend radially beyond the walls of the helical groove 12. Insert 65 is another angle of the drum 2, again showing that the walls of the helical groove 12 extend radially beyond, or are taller than, the line 6. Furthermore, this embodiment includes an extendable and retractable arm 61 that is locked into place manually by a user with a locking pin 63. The holes 62 in the extendable arm 61 permit a user to move the winch assembly 60 forward and lock it into place with a locking pin 63, or to move it backwards and lock it into place.

Figure 7:
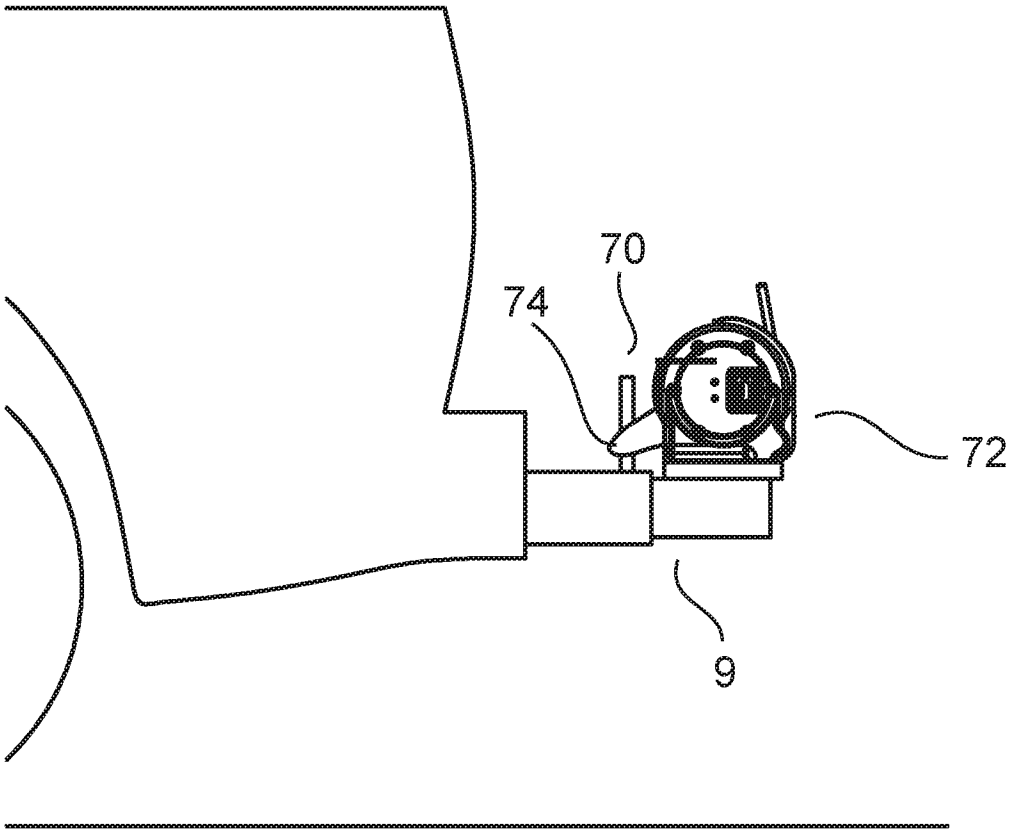
FIG. 7 is a side view of the winch assembly with a locking pin for holding the winch in a home position.

FIG. 7 shows the winch assembly 72 attached to the back of a truck. In this embodiment, the winch assembly 72 comprises a locking pin 70 for the guide 3. The locking pin 70 passes through an extension of the guide 74 and into the mount. This is advantageous because, while the winch assembly 72 is configured to swivel freely towards the load that it is pulling, it may swivel accidentally while a driver is using their vehicle to make turns or on a bumpy road. To prevent the winch from swiveling during times when a driver does not wish it to swivel, a locking pin 70 inserted through the guide 3 and the mount 9 prevents the winch assembly 72 from swiveling and holds it in a home position. Furthermore, to prevent the winch assembly 72 from swiveling when it is not desired to swivel, the mount may comprise a torsion spring. The torsion spring naturally pulls the winch assembly back to the home position when there is not a load pulling the winch out of a home position. The preferred home position is when the winch drum is perpendicular to the mount.

Figure 8:
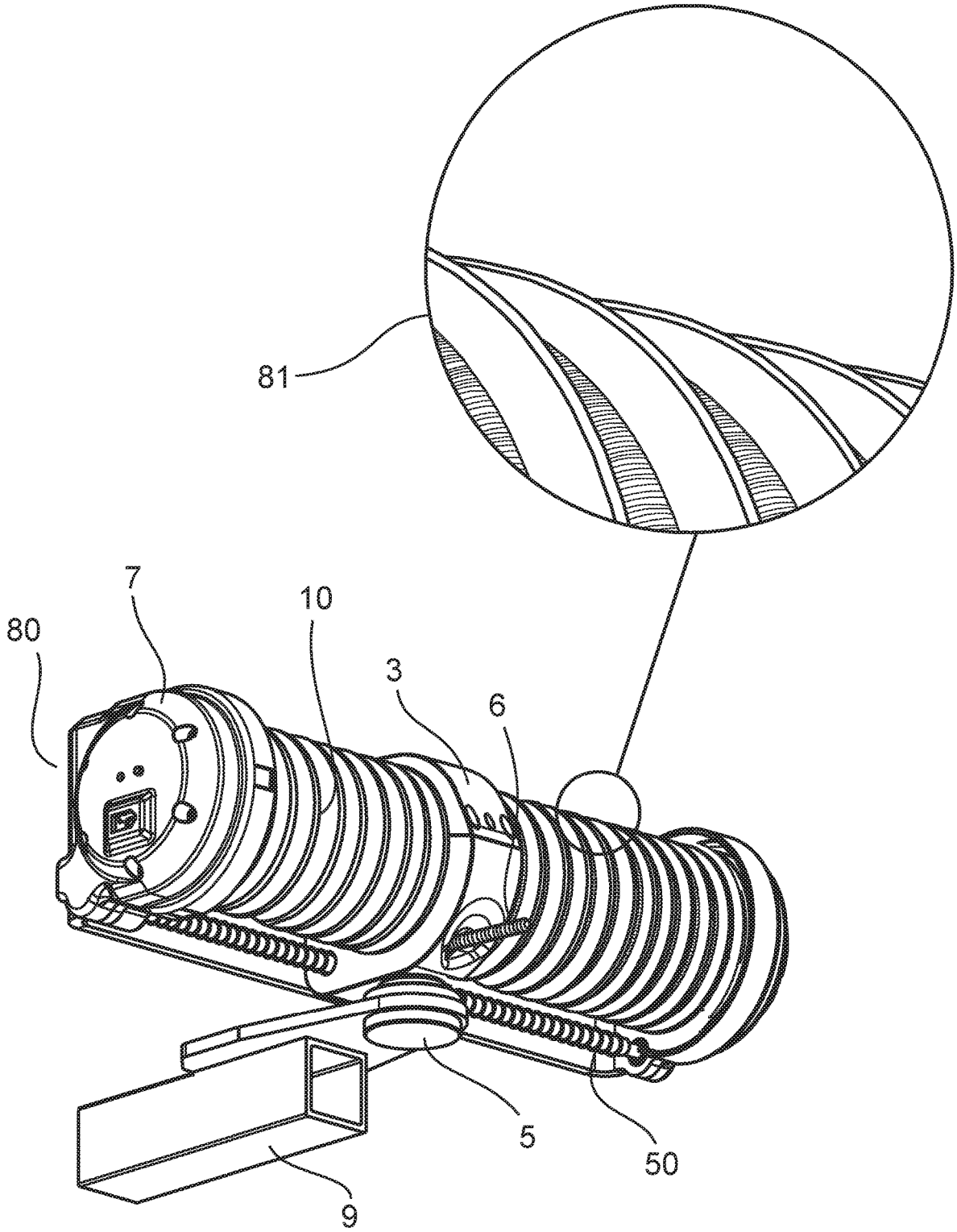
FIG. 8 is a front view of the winch assembly wherein the rod is threaded and the line does not mesh with the guide.

FIG. 8 illustrates a winch assembly 80 wherein the rod is a threaded rod 50. In this embodiment, the walls of the helical groove 12 extend radially beyond the line 6 such that the walls of the helical groove 12 mesh with the guide 3 because the guide is threaded with a mating pitch. The hole 11 in the guide 3, through which the rod passes, is threaded with a mating pitch. As the motor spins the drum, the threaded rod 50 also spins. Alternatively, the line 6 extends radially beyond the walls of the helical groove and meshes with the guide 3.

All patents and published patent applications referred to herein are incorporated herein by reference. The invention has been described with reference to various specific and preferred embodiments and techniques. Nevertheless, it understood that many variations and modifications may be made while remaining within the spirit and scope of the invention.

What is claimed is:

1. A winch assembly comprising:

a mount attachable to a vehicle;

a guide, attached to the mount and comprising a fairlead, having sensors in proximity to the orifice on the fairlead which detect pressure;

a winch, having a drum for winding and unwinding a line, and a motor for driving the drum about a winding axis, wherein the drum has a helical groove for receiving the line as it is wound, and wherein the line passes through the fairlead;

a frame connected to the first and second end of the drum, wherein the frame is adapted to move relative to the guide so as to synchronize movement of the drum along the winding axis so that the line passing through the fairlead is aligned with the helical groove during winding and unwinding; and a rod attached to the frame and generally parallel to the winding axis, and passing through a hole in the guide, so as to allow the movement of the drum along the winding axis but prevent the frame from rotating about the winding axis;

wherein the mount comprises a proximal end which attaches to the vehicle and a distal end that attaches to the guide and wherein the proximal end and distal end are pivotably connected, whereby the guide and winch are allowed to pivot about an axis perpendicular to the winding axis;

wherein the guide and winch pivot freely in response to a direction of an applied load;

wherein when pressure exceeds a predetermined threshold, the winch assembly swivels, tilts, or rotates in the direction that will relieve the sensed pressure.

2. The invention of claim 1, wherein walls of the helical groove extend radially a distance greater than a diameter of the line, and wherein an internal surface of the guide comprises a helical ridge that engages with the helical groove.

3. The invention of claim 2, wherein the mount comprises bearings to facilitate pivoting.

4. The invention of claim 1, wherein the line lays in the helical groove and radially extends beyond walls of the helical groove, and wherein an internal surface of the guide comprises a helical ridge that engages with the line in the helical groove.

5. The invention of claim 1, wherein the mount comprises a locking pin to prevent pivoting.

6. The invention of claim 1, wherein the proximal end of the mount comprises an extendable and retractable arm, whereby the guide and winch can be extended a greater distance from the vehicle to facilitate pivoting.

7. The invention of claim 6 wherein the extendable and retractable arm is motorized.

8. The invention of claim 6 wherein the extendable and retractable arm is manually operated.

9. The invention of claim 1, wherein the guide and winch are allowed to pivot through 90 degrees.

10. The invention of claim 1, further comprising a torsion spring attached to the guide and the mount for holding the winch in a home position when a load is not pulling the winch.

11. The invention of claim 1, wherein the rod and the guide are threaded.

12. The invention of claim 1, further comprising a battery to power the motor.

13. A winch assembly, comprising;

a mount attachable to a vehicle;

a guide, attached to the mount and comprising a fairlead, having sensors in proximity to the orifice on the fairlead which detect pressure;

a winch, having a drum for winding and unwinding a line, and a motor for driving the drum about a winding axis, wherein the drum has a helical groove for receiving the line as it is wound, and wherein the line passes through the fairlead;

a frame connected to the first and second end of the drum, and a threaded rod rotatably attached to the frame and generally parallel to the winding axis, and passing through a threaded hole in the guide, whereby, as the threaded rod is rotated about an axis parallel to the winding axis, the frame is moved along the winding axis and the frame is prevented from rotating about the winding axis;

wherein the movement of the frame by rotation of the threaded rod is configured to synchronize movement of the drum along the winding axis so that the line passing through the fairlead is aligned with the helical groove during winding and unwinding;

wherein the mount comprises a proximal end which attaches to the vehicle and a distal end that attaches to the guide and wherein the proximal end and distal end are pivotably connected, whereby the guide and winch are allowed to pivot about an axis perpendicular to the winding axis;

wherein the guide and winch pivot freely in response to a direction of an applied load;

wherein when pressure exceeds a predetermined threshold, the winch assembly swivels, tilts, or rotates in the direction that will relieve the sensed pressure.

14. The invention of claim 13, wherein walls of the helical groove extend radially a distance greater than a diameter of the line, and wherein an internal surface of the guide comprises a helical ridge that engages with the helical groove.

15. The invention of claim 13, wherein the line lays in the helical groove and radially extends beyond walls of the helical groove, and wherein an internal surface of the guide comprises a helical ridge that engages with the line in the helical groove.

16. The invention of claim 13, wherein the mount comprises a proximal end which attaches to the vehicle and a distal end that attaches to the guide and wherein the proximal end and distal end are pivotably connected, whereby the guide and winch are allowed to pivot about an axis perpendicular to the winding axis.

17. The invention of claim 16, wherein pivoting of the guide and winch is automated.

18. The invention of claim 13, further comprising gears, such that as the motor drives the drum about the winding axis, the gears are rotated, and the rod is driven about an axis.

* * * * *